United States Patent [19]

Case

[11] 4,017,101

[45] Apr. 12, 1977

[54] LETTER OF CREDIT DEVICE

[76] Inventor: John M. Case, 35 Lehigh Road, Wellesley, Mass. 02181

[22] Filed: May 20, 1976

[21] Appl. No.: 688,313

[52] U.S. Cl. ..... 283/57; 283/59
[51] Int. Cl.[2] ..... B42D 15/00
[58] Field of Search ..... 283/57–59, 283/9 R, 9 A, 51

[56] References Cited

UNITED STATES PATENTS

| | | | |
|---|---|---|---|
| 1,334,593 | 3/1920 | Bridges | 283/59 |
| 1,783,258 | 12/1930 | Opitz | 283/59 |
| 3,671,059 | 6/1972 | Zeller | 283/58 X |

*Primary Examiner*—Lawrence Charles
*Attorney, Agent, or Firm*—Russell & Nields

[57] ABSTRACT

A letter of credit device consisting of the combination of a card and a check. The card has a plurality of numerical columns each of which is headed by a numeral and also a plurality of transaction sections extending across the numerical columns and having a punch out element in each of the numerical columns so that, by selective punch outs, the dollar value of each of the transactions is irrevocably recorded. The check and card each identify the issuing bank and the account number of the holder. In addition the card carries an identification of the holder, including his signature, and also states the terms under which a negotiating party is guaranteed payment for any sum paid under the negotiated transaction. The check also has a punch out section, which the negotiating party punches out, before forwarding the check for payment to the issuing bank, as a representation that the negotiation was under the card and in accordance with the terms on the card.

5 Claims, 4 Drawing Figures

FIG. 1

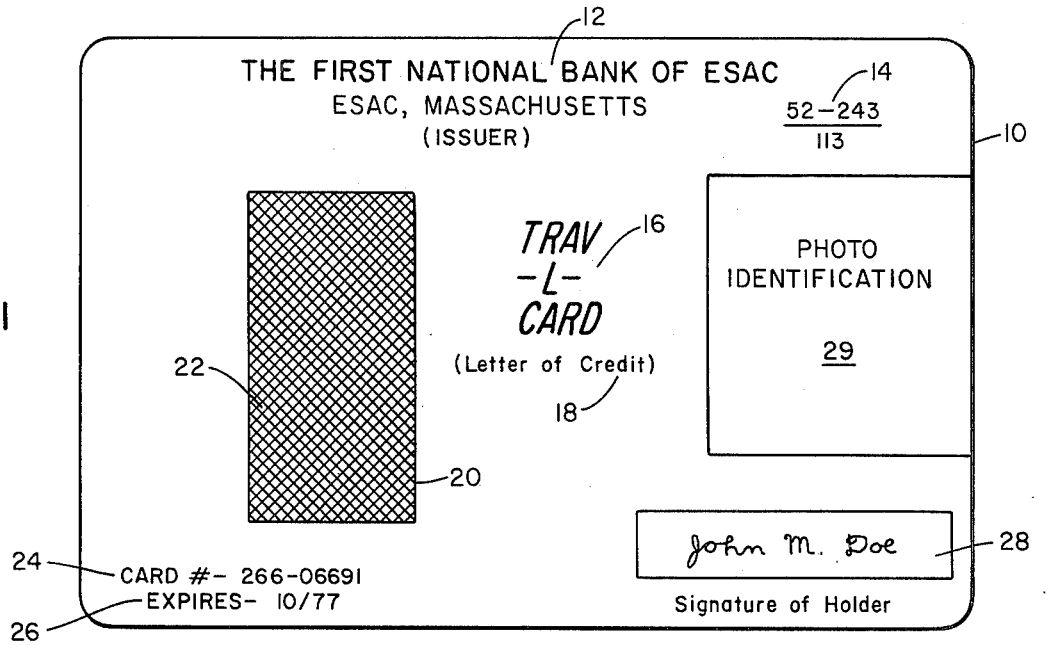

FIG. 2

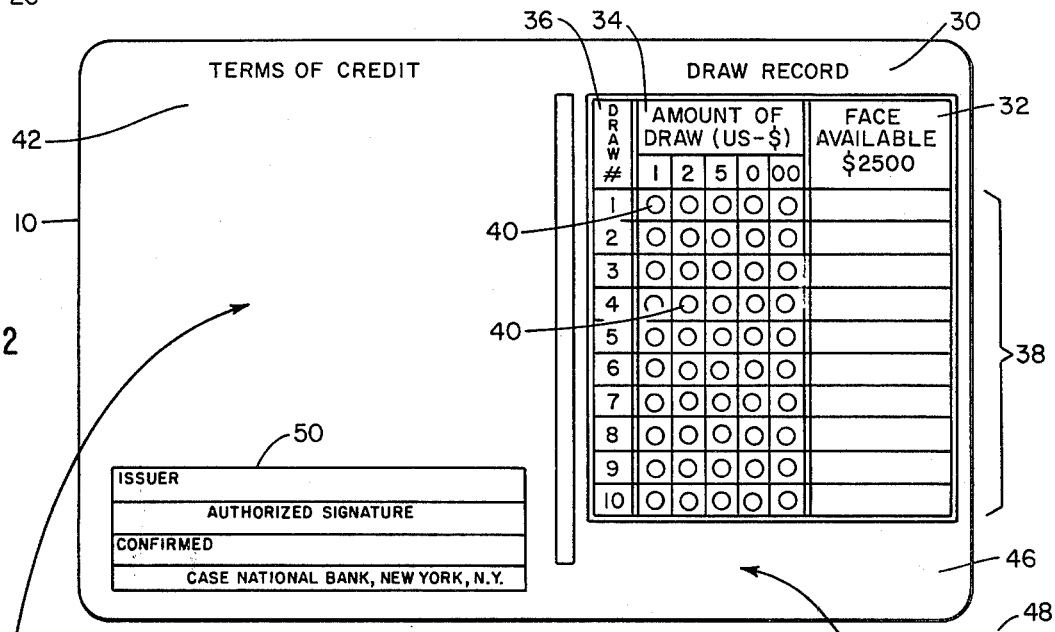

| DRAW # | AMOUNT OF DRAW (US-$) 1 | 2 | 5 | 0 | 00 | FACE AVAILABLE $2500 |
|---|---|---|---|---|---|---|
| 1 | O | O | O | O | O | |
| 2 | O | O | O | O | O | |
| 3 | O | O | O | O | O | |
| 4 | O | O | O | O | O | |
| 5 | O | O | O | O | O | |
| 6 | O | O | O | O | O | |
| 7 | O | O | O | O | O | |
| 8 | O | O | O | O | O | |
| 9 | O | O | O | O | O | |
| 10 | O | O | O | O | O | |

The Issuer opens this irrevocable Letter of Credit in favor of any Bank, Banker or Trust Company (Beneficiary) for reimbursement of a negotiation under this Trav-L-Card (Card) within the Face amount, as reduced by Draw(s), provided the following terms are met — 1. Draw is documented by check payable to order of Beneficiary, drawn by Holder on Issuer. 2. Customers account # on check is identical to Trav-L-Card #. 3. Beneficiary a. Punches out Amount of Draw on Draw Record. b. Enters a reduced Available Amount. c. Punches out Trav-L-Card symbol on check and d. Endorses on Check Expires date of Card, and Draw # used.

Instructions

Amount of Draw (Minimum $10 must be an amount recordable by Punch Out of next available Draw # line. To record Amount of Draw, make Punch Outs so that the figure resulting from a left to right reading of the aggregate numbers in the heads of the columns Punched Out equals check amount.

ie 1+0=$10; 1+00=$100; 1+2+0=$120; 1+0+00=$1000 etc.

FIG. 3
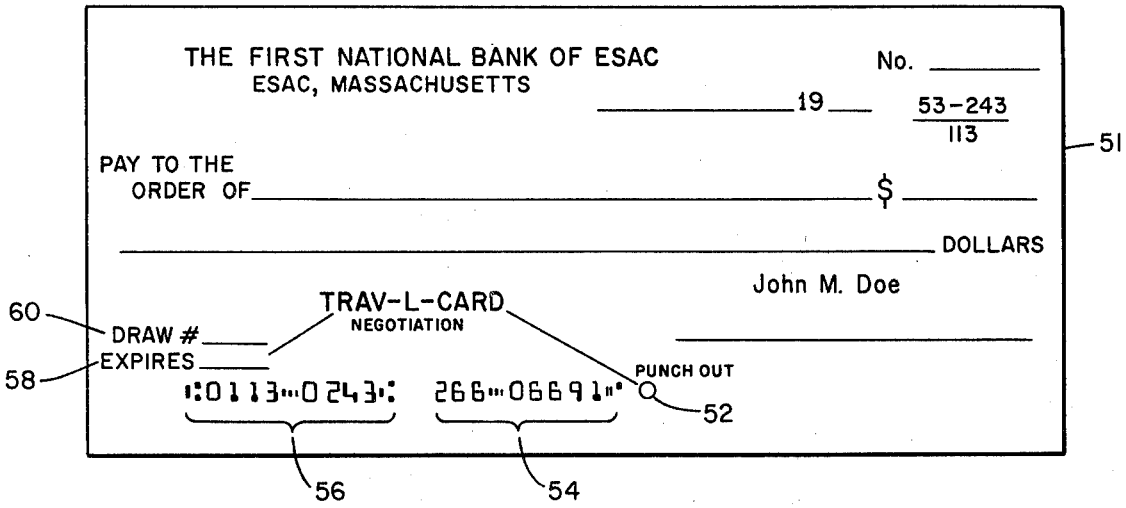
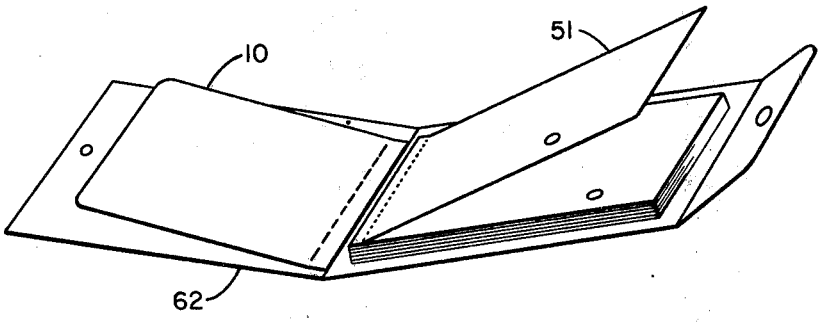
FIG. 4

LETTER OF CREDIT DEVICE

BACKGROUND OF THE INVENTION

In order to facilitate personal financial transactions by travellers, various services have been provided by means of such instrumentalities as credit cards, travellers'checks, travellers' letters of credit and bankers drafts drawn on banking correspondents. Such instrumentalities, while providing desirable services and advantages, nevertheless suffer from a number of drawbacks and inconveniences both to the financial institutions involved and to the holders of such instrumentalities. None of them offer facilities for a traveller to negotiate a personal check in a manner sufficiently secure to obviate the uncertainties and delays inherent in such prior devices.

The present invention has, as a principal object, the provision of a new card type device, to be used in combination with a novel form of personal check, which makes possible a set of financial procedures whereby the holder of such a device may negotiate a personal check, in area remote from his issuing bank, with such secure quarantees to the negotiating party, that the transaction may be carried out expeditiously. In addition such a new device provides a complete and current set of data, to the holder, the issuing bank and the negotiating party, which data represents a duplicate record of that which is recorded on the books of the issuer and shows, to both the negotiating party and the holder, the same details which are available to the issuer.

SUMMARY OF THE INVENTION

The invention comprises a card of a type which may be conveniently carried on the person of the holder. On the card is imprinted, the maximum amount of dollar credit quaranteed by the card; and instructions to the negotiating party as to what steps must be taken to insure that the terms of credit provided by the card are complied with. One face of the card bears a plurality of imprinted numerical columns, one of which is headed by a ten multiplier, another of which is headed by a hundred multplier and each of the remaining columns being headed by a numerical integer. Extending across such columns are a plurality of transaction portions, each of which contains a punch out element in each of such columns in such a manner that, by selectively punching out the proper punch out element, the amount of each negotiating transaction may be read easily and unambiguously. Each transaction section also has an extended blank section upon which the negotiating party is required to write the balance of the dollar credit remaining after deducting the amount of the draw negotiated. The card also has permanently imprinted therein, additional information by which the negotiating party may identify the parties involved and the validity and current status of the quaranteed credit.

The card is used in combination with a personal check of the card holder. The format of the check is such as to comply with its accepted standards of the Bank Management Commission of American Bankers Association and in addition is provided with a punch out section in a location outside of that reserved for the magnetic ink character recognition accepted standards. However, the punch out section is located so that the removal of the punch out is clearly readable, either visually by the bank employees or automatically by a standard type of detecting device. The removal of the punch out section provides a positive indication by the negotiating party that the check has been accepted under the terms of the card as described above.

BRIEF DESCRIPTION OF THE DRAWINGS

FIG. 1 is a face view of the novel letter of credit card;

FIG. 2 is a view of the reverse side of the card of FIG. 1;

FIG. 3 is a face view of the check which is used in combination with the card of FIG. 1. and FIG. 2; and FIG. 4 is an illustration of the combination of the card and checks pyhsically united in a common folder.

DETAILED DESCRIPTION OF THE PREFERRED EMBODIMENT

In the drawings, 10 is a flat card of some tough durable natural, such as plastic, of a size to fit conveniently into a standard wallet. In this respect it is similar to the usual plastic credit card. It is imprinted on its face with an identification 12 of the name and location of the issuer, the fractional ABA (American Bankers Association) routing number 14 for the issuer, a characteristic trade name 16 for the card, and an identification 18 of the general nature of the card. One portion of the face of card 10 is coated with a relatively thin lamina 20 of frangible material bearing any suitable medallion design 22 upon its surface in order that any fracturing of the lamina 20 will become irrevocally apparent.

At the time the card is issued its face is permanently embossed with a number 24 corresponding to the usual account number assigned to the holder of the card. This number is the same as will appear on the personal check form of the holder. At the same time, an expiration date will be given to the card and such date will also be embossed on the face of the card at 26.

A strip 28 bearing the signature of the holder is also affixed to the face of the card and is preferably laminated onto the card with a transparent plastic layer covering the signature so as to preserve its integrity. For further identification a photograph of the holder may be laminated into the surface of the card at 29.

The operative portion of the card is illustrated in FIG. 2 which shows the reverse side of the card of FIG. 1. This consists principally of the "DRAW RECORD" section 30. Along the top right hand portion 32 of section 30 is imprinted, preferably by embossing, the total number of dollars available to be drawn or negotiated under the card. Such amount may be characterized as "FACE AVAILABLE". Along the top central portion of section 30 and spanning a number of vertical columns, is a portion 34, entitled "AMOUNT OF DRAW (U.S.$)". Each of the columns under portion 34 is headed by a distinctive numeral. As illustrated, the left hand column is headed by the number 1, the next column by the number 2, the next column by the number 5, the next column by a zero and the extreme right hand column by two zeros. This arrangement of numerals, as will be explained below, provides a simple and very compact arrangement for the recording of each of the amounts drawn by each negotiation under the card. At the top of its left hand portion of section 30 is a column 36 headed by the designation of "DRAW NO". Extending transversely across the section 30 under all of the above headings are a plurality of draw transaction portions 38, numbered, typically from 1 to 10. Each portion 38, where it subtends a column of portion 34, is provided with a punch out element 40. While such a punch out element may take various forms, it preferably consists of a circular disc area of the card 10 which is scored around its perimeter so as to leave but a thin portion which is readily broken away by pressing on the disc by any suitable pointed instrument. It will further be noted that the medallion imprinted lamina 20 directly underlies the punch out portion of the "DRAW RECORD" section 30 so that each removal of a punch out element 40 will rupture the lamina 20 and thus produce an irrevocable indication of each such punch out action. Where each draw transaction portion 38 extends below the "FACE AVAILABLE" portion 32, such portion 38 is provided with a blank surface upon which the negotiating party must enter an amount in ink in accordance with instructions appearing on the card, as will be explained below.

As shown in FIG. 2, to the left of "DRAW RECORD" section 30, is a "TERMS OF CREDIT" section 42, on which is imprinted the details of the terms under which the negotiating party will be reimbursed by the issuing bank for any sums paid to the holder of the card by the negotiating party. For clarity of illustration, a typical set of such terms as they appear on the card are set forth in the block 44 below the illustration of card 10 in FIG. 2.

A section 46, below the "DRAW RECORD" section 30 has imprinted upon it a set of "Instructions", also for the sake of clarity, set forth in the block 48 below the illustration of card 10 in FIG. 2.

In a manner similar to that described for the signature strip 28 of FIG. 1, the reverse side of card 10, as shown in FIG. 2, is provided with (a) signature strip(s) 50 both for the signature (s) of an authorized agent of the issuing bank, and that of a confirming bank.

The advantage of the particular configuration of the "AMOUNT OF DRAW" portion 34, and of the columns within it, will become apparent from the "Instructions" which, in the form illustrates reads as follows:

> "Amount of Draw (Minimum $10) must be an amount recordable by Punch Out on next available Draw No. line. To record Amount of Draw, make Punch Outs so that the figure resulting from a left to right reading of the aggregate numbers in the heads of the columns Punched Out equals check amount. ie 1+0=$10; 11+00=$100; 1+2+0=$120; 1+0+00=$1000 etc."

From the above it will be seen that, in the example illustrated in FIG. 2, any sequence of punched out numerals in the three hand columns, when read in their left to right reading, will be multiplied by ten, if the zero column is punched out; will be multiplied by one hundred, if the double zero column is punched out, and by one thousand if both the single zero and double zero columns are punched out. This compact arrangement thus makes possible the recording of the amount of any sum which would normally be negotiated under the provisions of the card.

As indicated above, the card is to be used in combination with a specially modified personal check of the holder of the card. Such a check is shown at 51 in FIG. 3. The check shown, conforms to the standards prescribed by the Bank Management Commission of the American Bankers Association. However, it is modified by providing a punch out section 52. In the form shown the punch out section 52 is located to the right of the account number 54 which is imprinted on the face of the check in magnetic ink. This places the punch out 52 with the field designated as the "ON-US" field in said standards. Alternatively, the punch out 52 could be located to the left of the routing symbol 56, also imprinted in magnetic ink on the face of the check. In the letter case, the punch out 52 would be located in the "Auxiliary ON-US" field as defined by said standards. In any case, the location of the punch out 52 is such that it will not interfere with the normal machine processing of such checks. Furthermore, the fact that a punch out 52 has been made will become immediately apparent to tellers who process checks visually, and can be readily read by a machine provided with an automatic reading device, such as, for example, a standard lamp and photo-cell combination, in which the light of the lamp shining through the punch out hole will actuate the photo-cell to produce the necessary identification signal when the punch out has been made.

The manner in which the card and check are to be treated in a negotiation is detailed in the "TERMS OF CREDIT" block 44 which reads as follows:

> "The Issuer opens this irrevocable Letter of Credit in favor of any Bank, Banker or Trust Company (Beneficiary) for reimbursement of a negotiation under this Trav-L-Card (Card) within the Face amount, as reduced by Draw(s), provided the following terms are met —1. Draw is documented by check payable to order of Beneficiary, drawn by Holder on Issuer. 2. Customers account No. on which is identical to Trav-L-Card No. 3. Beneficiary a. Punches out Amount of Draw on Draw Record. b. Enters a reduced Available Amount. c. Punches out Trav-L-card symbol on check and d. Endorses on Check Expires date of Card, and Draw No. used."

The procedure followed by a negotiator, when presented with the card and check for a specific amount of money within the limits as stated on the card, is substantially as follows. The negotiator verifies the identity of the holder by his photograph at 29 and his signature at 28. Then, after noting the identity of the issuer bank with bank on which the check is drawn, and verifying its authorization signatures 50 he compares the card number at 24 with the account number on the check at 54. He then looks whether any punch outs have been made in the card and verifies that the balance available for payment to the holder is sufficient to include the amount of the check. After verifying the fact that that expiration date at 26 has not expired, he writes that expiration date at the point 58 provided for that purpose on the face of the check and also writes the draw number of the negotiation involved at the point 60 provided for such purpose on the face of the check. He then punches out the amount of the check, following the instructions at 48, punches out the check at 52 and makes the requested payment of money to the card holder.

At the issuer bank, the presentation of the check, with the portion 52 punched out, by the negotiating party for payment, is a quarantee by the negotiating party that the check was in fact negotiated under a card with the same number as the account number on the check. Any check in which no punch out has been made is processed by the bank as a regular check and charged against that part of the depositors checking account not reserved for payments under the guarantee of the card. The check in which the punch out has been made is processed by the bank under the terms of the card and is charged against the portion of the depositor's checking account reserved for payment under the card. As previously pointed out, the presence of a punched out hole in the check enables the check to be visually and automatically routed into the proper processing channel.

As contrasted with prior systems, in the present invention the data on the card is a duplicate record, with the card holder, of the data as recorded on the books of the issuer as soon as the negotiated check has been processed as described above. In addition the card presents both to the negotiating party and to the holder the same details as are available to the issuer. All of this makes possible a wide variety of new accounting and financial procedures, limited only by the ingenuity of the accounting personnel involved, which will yield substantial profit advantages to all of the parties involved.

In the use of the present invention, the card holder makes conventional banking arrangements with the issuer at the time of the card's issuance. This can involve arrangements for the issuance of the card on either a cash or credit basis. As a check clears through the proper processing channel, as described above, the punched out check will be debited against a letter of credit account, which normally is maintained in a separate ledger control for the card involved. With the transaction having been reflected on the appropriate card ledger, it will then be immediately charged out to the general depositor's ledgers, and receive a final and ultimate charge on the holder's individual account.

For the issuer of a card under this invention, there is the major profit advantage that balances to pay for the usual traveller's check or the traveller's letter of credit are not transferred out at the time of purchase to another financial institution which is the paying point for the traveller's check or drafts under the traveller's letter of credit, For the holder of the card, aside from the added convenience and safety involved, the advantages are that he need not make payment for a service he might not fully utilize, as would be the case for unused and uncashed traveller's checks. For those institutions which pay interest on the funds retained in the holder's account, he will be receiving the interest income, the lack of which is probably the most costly part to the holder of a traveller's check purchase. Other advantages arising from the present invention will suggest themselves to those knowledgable in this art.

Variations in the details of the invention as described above will suggest themselves. For example, although the card and check are shown and described separately in FIGS. 1, 2, and 3, they might very well be physically joined as, for example, shown in FIG. 4. In this figure a folder 62 has bound therein a card 10 and a supply of checks 51, each as described above. Each check is detachable from the folder so that upon being negotiated, it may be removed for forwarding to the issuing back. Further, the integers used in the left hand columns of position 34 are not necessarily those shown, since other integers might be used from which the magnitude of draw could be derived. Likewise, the punch outs in the card do not necessarily require portions of the card to be removed. Any fracturing or irrevocable distortion of the card at the punch out areas might well serve the same purpose. The preservation of the security of the other data on the card might also be accomplished by means other than that specifically described above. Although, in the above example, the beneficiary is described at 42 and 44 as a "Bank, Banker or Trust Company" the invention may be applied with respect to any other party negotiating the grant of credit under the card. Various other modifications within the scope of the appended claims, will suggest themselves to those skilled in the art.

What is claimed is:

1. A letter of credit device to be used by an authorized holder comprising in combination:

a. a flat card having a plurality of numerical columns, each of which is headed by a characteristic numeral and a plurality of transaction sections extending across said numerical columns and containing a punch out element in each of said numerical columns, whereby the amount of each of said transactions may be indicated by selectively punching out punch out elements in said transaction section; and b. an idividual account check drawn on an issuing financial institution;

c. said card and check each having imprinted on it an identification of the issuing institution and the same account number of the holder, d. said card bearing an identification of the holder, including his signature, and also bearing the terms and instructions upon which credit is to be issued to the holder by a negotiating party; and e. said check having a punch out element, whereby, when punched out, it serves to identify to the issuing bank that said check was negotiated under said card.

2. The combination of claim 1 in which one of the numerical columns of said card is headed by a ten multiplier, another of which is headed by a hundred multiplier and each of the remaining columns are headed by a numerical integer.

3. The combination of claim 2 in which each of said transaction sections has a segment extending beyond said numerical columns, said segment having a surface upon which a number may be written by the negotiating party in accordance with said instruction.

4. The combination of claim 3 in which each of said transaction sections has a segment upon which a transaction member is imprinted.

5. The combination of claim 3 in which said card is imprinted with an expiration date and said check is imprinted with a blank on which the negotiating party may write said expiration date, and said check is also imprinted with a blank on which the negotiator may write the number of the transaction under which he has negotiated the check.

* * * * *